US010006453B2

(12) United States Patent
Girard et al.

(10) Patent No.: US 10,006,453 B2
(45) Date of Patent: Jun. 26, 2018

(54) METHOD FOR OPERATING A PERISTALTIC PUMP

(71) Applicant: Fresenius Vial SAS, Brézins (FR)

(72) Inventors: Guillaume Girard, La cote saint André (FR); Sébastien Labarthe, Voiron (FR)

(73) Assignee: Fresenius Vial Sas, Brezins (FR)

( * ) Notice: Subject to any disclaimer, the term of this patent is extended or adjusted under 35 U.S.C. 154(b) by 427 days.

(21) Appl. No.: 14/441,295

(22) PCT Filed: Oct. 28, 2013

(86) PCT No.: PCT/EP2013/072479
§ 371 (c)(1),
(2) Date: May 7, 2015

(87) PCT Pub. No.: WO2014/072195
PCT Pub. Date: May 15, 2014

(65) Prior Publication Data

US 2015/0292500 A1 Oct. 15, 2015

Related U.S. Application Data

(60) Provisional application No. 61/725,604, filed on Nov. 13, 2012.

(30) Foreign Application Priority Data

Nov. 9, 2012 (EP) ..... 12306393

(51) Int. Cl.
*F04B 49/06* (2006.01)
*F04B 43/08* (2006.01)
(Continued)

(52) U.S. Cl.
CPC ..... *F04B 49/06* (2013.01); *F04B 43/08* (2013.01); *F04B 43/082* (2013.01);
(Continued)

(58) Field of Classification Search
CPC ..... F04B 49/06; F04B 43/08; F04B 43/082; F04B 43/1223; F04B 49/065; F04B 53/10; F04B 51/00; F04B 2205/05
(Continued)

(56) References Cited

U.S. PATENT DOCUMENTS 4,460,355 A * 7/1984 Layman ..... A61M 5/16859 222/40
5,103,211 A * 4/1992 Daoud ..... A61M 5/16859 128/DIG. 13
(Continued)

FOREIGN PATENT DOCUMENTS

EP 0121931 10/1984

*Primary Examiner* — Dominick L Plakkoottam
*Assistant Examiner* — Benjamin Doyle
(74) *Attorney, Agent, or Firm* — Occhiuti & Rohlicek LLP

(57) ABSTRACT

A peristaltic pump comprises a flexible tube, a compression mechanism being actuatable for compressing the flexible tube, an upstream valve mechanism being actuatable to selectively open or close the tube upstream of the compression mechanism and a downstream valve mechanism being actuatable to selectively open or close the tube downstream of the compression mechanism. A drive mechanism actuates the compression mechanism, the upstream and downstream valve mechanisms. A pressure sensor measures a pressure signal indicative of a pressure in the tube between the upstream and downstream valve mechanisms. First and second signal values indicative of a pressure value downstream the downstream valve mechanism and upstream the upstream valve mechanism, respectively, are computed from the measured pressure signal. A threshold value is computed from the first and second signal values, and the measured pressure signal or a derived signal parameter is compared with the threshold value to detect a fault condition.

11 Claims, 5 Drawing Sheets

(51) Int. Cl.
*F04B 43/12* (2006.01)
*F04B 53/10* (2006.01)

(52) U.S. Cl.
CPC ..... *F04B 43/1223* (2013.01); *F04B 49/065* (2013.01); *F04B 53/10* (2013.01)

(58) Field of Classification Search
USPC ..... 417/28
See application file for complete search history.

(56) References Cited

U.S. PATENT DOCUMENTS 5,180,287 A * 1/1993 Natwick ..... A61M 5/142 340/606
5,292,306 A * 3/1994 Wynkoop ..... A61M 5/16854 417/53
5,336,053 A * 8/1994 Wynkoop ..... A61M 5/16854 417/53
5,679,245 A * 10/1997 Manica ..... A61M 1/16 210/134
5,807,322 A * 9/1998 Lindsey ..... A61M 5/16859 604/65
5,827,223 A * 10/1998 Butterfield ..... A61M 5/16859 604/65
5,980,490 A * 11/1999 Tsoukalis ..... F04B 43/082 417/474
8,313,308 B2 * 11/2012 Lawless ..... A61M 5/14224 417/44.1
9,101,712 B2 * 8/2015 Denis ..... G06F 19/3468
2005/0043665 A1 * 2/2005 Vinci ..... A61M 1/1086 604/5.01
2005/0145010 A1 * 7/2005 Vanderveen ..... A61M 5/16827 73/1.57
2007/0274843 A1 * 11/2007 Vanderveen ..... A61M 5/14228 417/63
2012/0283691 A1 * 11/2012 Barnes ..... A61M 5/00 604/500
2014/0294610 A1 * 10/2014 Labarthe ..... A61M 5/14228 417/213
2015/0292500 A1 * 10/2015 Girard ..... F04B 43/082 417/53

* cited by examiner

METHOD FOR OPERATING A PERISTALTIC PUMP

CROSS REFERENCE TO RELATED APPLICATIONS

This application is a National Stage of International Application No. PCT/EP2013/072479 filed on Oct. 28, 2013, which claims priority to European Application No. 12306393.5 filed on Nov. 9, 2012 and U.S. Provisional Application No. 61/725,604 filed on Nov. 13, 2012, the contents of which are hereby incorporated by reference in their entirety.

The invention relates to a method for operating a peristaltic pump according to the preamble of claim 1 and a peristaltic pump.

A peristaltic pump operated by such a method comprises a flexible tube for guiding liquid to a pump, a compression mechanism being actuatable for compressing the flexible tube, an upstream valve mechanism arranged in an upstream direction with respect to the compression mechanism and being actuatable to selectively open or close the flexible tube upstream of the compression mechanism, and a downstream valve mechanism arranged in a downstream direction with respect to the compression mechanism and being actuatable to selectively open or close the flexible tube downstream of the compression mechanism.

By means of the upstream valve mechanism and the downstream valve mechanism, the flexible tube can at two locations be selectively opened or closed to let the liquid pass through the flexible tube. By means of the compression mechanism, the flexible tube is compressed in a section between the upstream valve mechanism and the downstream valve mechanism such that, by sequential actuation of the compression mechanism, the upstream valve mechanism and the downstream valve mechanism a liquid may be transported along the downstream direction within the flexible tube.

For actuating the compression mechanism, the upstream valve mechanism and the downstream valve mechanism the peristaltic pump comprises a drive mechanism (for example in the shape of a drive shaft carrying a number of cams) acting onto the compression mechanism, the upstream valve mechanism and the downstream valve mechanism. The drive mechanism herein periodically actuates the compression mechanism, the upstream valve mechanism and the downstream valve mechanism such that, in a periodic pumping operation, the liquid is pumped through the flexible tube.

A peristaltic pump of this kind is for example known from U.S. Pat. No. 5,807,322.

In the peristaltic pump of U.S. Pat. No. 5,807,322, a position sensor for detecting the rotational position of the drive shaft during actuation of the compression mechanism, the upstream valve mechanism and the downstream valve mechanism is provided, which in combination with a pressure sensor being arranged between the upstream valve mechanism and the downstream valve mechanism and a controller to control the operation of the peristaltic pump is used to detect fault conditions during operation of the peristaltic pump, for example caused by an occlusion of the flexible tube upstream of the upstream valve mechanism or downstream of the downstream valve mechanism or caused by a so-called empty-bag condition indicating that a bag supplying liquid to the flexible tube is empty.

For detecting a fault condition, U.S. Pat. No. 5,807,322 proposes to observe a pressure signal output by the pressure sensor in certain intervals during the periodic pumping operation. For example, if a pressure signal is measured in an interval during the pumping operation in which the upstream valve mechanism is opened and the downstream valve mechanism is closed, the measured pressure signal is indicative of an upstream pressure. Vice a versa, if a pressure signal is measured while the upstream valve mechanism is closed and the downstream valve mechanism is opened, the measured pressure signal is indicative of a downstream pressure. Thus, by detecting changes in the upstream pressure and/or the downstream pressure it may be determined whether an occlusion of the flexible tube is present preventing a correct pumping operation.

U.S. Pat. No. 5,807,322 proposes to relate a measured pressure signal to predetermined threshold values to for example detect an upstream or a downstream occlusion indicating that the tube guiding the liquid is occluded upstream or downstream of the peristaltic pump.

Setting such a threshold value, however, can be difficult because the conditions for the pumping operation of the peristaltic pump may alter over time, caused for example by mechanical wear and tear of the flexible tube, aging of the tube and/or temperature changes during the pumping operation. Furthermore, the setup of a flexible tube in a peristaltic pump may change from pump to pump and from tube to tube, dependent for example on the compressional holding forces by which the flexible tube is held on the peristaltic pump, for example between a holding plate and a door of the peristaltic pump.

When a pressure signal is measured by a pressure sensor, the signal indicates the pressure inside the flexible tube, modified however by an acquisition chain via which the output of the pressure sensor is linked to the actual, physical pressure inside the flexible tube. The acquisition chain, for example, is influenced by the size of the surface area of the pressure sensor abutting the flexible tube, by forces via which the flexible tube is squeezed in a holding mechanism on the peristaltic pump, and by the transfer function of the pressure sensor circuitry (incorporating for example also an amplification circuitry). Hence, to be able to determine the pressure inside the flexible tube from the pressure signal output by the pressure sensor, the system must be calibrated for example by measuring the pressure signal at a known pressure inside the flexible tube. For calibration, the pressure signal may for example be computed at two known pressures controlled for example by a manometer, for example a pressure of 0 bar and 1 bar inside the flexible tube. From such calibration measurements it then can be determined how the measured pressure signal relates to the actual pressure inside the flexible tube, such that the actual pressure value inside the tube can be determined from the pressure signal output by the pressure sensor. Using such a calibration, the threshold for example for detecting an upstream occlusion or a downstream occlusion can then be set in bar, hence in terms of the actual pressure inside the tube.

A calibration of this kind is typically carried out only once prior to installing the system at a user's site. Once installed for example at a hospital site, the calibration is usually not repeated, and the initial calibration is used throughout the operation of the pump. Because the operational condition of the pump and its components alters during their lifetime and because the setup of a pump may be changed after installation (for example because a door of a peristaltic pump is replaced), such systems may exhibit a substantial dispersion over their lifetime rendering the initial calibration largely inaccurate. If the threshold is expressed in bar (in terms of the actual pressure inside the tube) and hence requires conversion of the measured pressure signal output by the pressure sensor into the actual pressure value inside the tube, the comparison of the actual pressure derived from the measured pressure signal and the threshold also becomes inaccurate, possibly leading to false alarms or no alarms where an alarm should have been triggered.

In a peristaltic pump known from U.S. Pat. No. 5,827,223 a compression mechanism is provided in the shape of a number of peristaltic pump fingers acting onto a flexible tube and arranged between a most downstream peristaltic finger constituting a downstream valve mechanism and a most upstream peristaltic finger constituting an upstream valve mechanism. A pressure sensor is arranged at a location downstream of the downstream valve mechanism and measures a pressure difference between a maximum and a minimum of a downstream pressure signal. Such pressure difference is related to a primary threshold and a secondary threshold for determining whether a downstream or an upstream occlusion is present.

A similar system is also known from U.S. Pat. No. 5,103,211.

It is an object of the instant invention to provide a method for operating a peristaltic pump and a peristaltic pump which allow for a safe and reliable detection of a fault condition such as an upstream occlusion or a downstream occlusion.

This object is achieved by a method for operating a peristaltic pump comprising the features of the claim 1.

Accordingly, for detecting a fault condition, a first signal value indicative of a pressure value downstream the downstream valve mechanism and a second signal value indicative of a pressure value upstream the upstream valve mechanism are computed from the measured pressure signal. A threshold value is computed from the first signal value and the second signal value, and the measured pressure signal or at least one signal parameter derived from the measured pressure signal is compared with this threshold value to detect the fault condition.

The invention is based on the idea to determine a threshold value from the measured pressure signal itself. With this approach it no longer is necessary to set a threshold value for example for determining an upstream occlusion or a downstream occlusion in terms of the actual pressure inside the tube (in bar) such that in principle a calibration of the system for determining a conversion of the measured pressure signal into the actual pressure inside the flexible tube is not necessary. The threshold value is computed from signal values determined during operation of the system, wherein the computation of the threshold value may be repeated continuously for each cycle of the periodic actuation of the peristaltic pump or may be repeated at least in certain time intervals.

For determining the threshold value, a first signal value indicative of a pressure value downstream the downstream valve mechanism and a second signal value indicative of a pressure value upstream the upstream valve mechanism are computed from the measured pressure signal. From the first signal value and the second signal value, then, the threshold value is derived, and the measured pressure signal or a signal parameter derived from the measured pressure signal is compared with the threshold value to detect a fault condition. The measured pressure signal in this regard represents a signal output by the pressure sensor and indicates the pressure inside the flexible tube modified by an acquisition chain via which the pressure sensor senses the pressure inside the flexible tube. The acquisition chain takes into account for example the surface area by which the pressure sensor abuts the flexible tube, a biasing force due to the squeezing of the flexible tube for example by means of a door of the peristaltic pump, and the transfer function of the pressure sensor (incorporating for example also an amplification of the measured pressured signal).

By deriving the first signal value and the second signal value directly from the measured pressure signal—without conversion to the actual pressure inside the flexible tube—an initial calibration of the sensing system in principle becomes unnecessary. Hence, the influence of an inaccurate calibration may be avoided. Furthermore, influences by the system's dispersion over its lifetime due to, for example, mechanical wear and tear, changing temperatures or modifications in the system's setup (due to, for example, replacement of the door of the peristaltic pump) are reduced, because the threshold value is computed from the measured pressure signal itself in a repeated fashion such that the threshold value takes the dispersion of the system into account.

By the proposed approach beneficially a downstream occlusion or an upstream occlusion can be detected. In case of a downstream occlusion typically the first signal value indicative of the pressure downstream of the downstream valve mechanism is increased, whereas in case of an upstream occlusion the second signal value indicative of the pressure upstream the upstream valve mechanism is decreased. During normal pumping operation, in which no fault condition is present, the difference of the first signal value and the second signal value typically is small, i.e. approximately zero. However, in case of a downstream occlusion or an upstream occlusion, the difference increases such that, as signal parameter, the difference between the first signal value and the second signal value may be determined and compared with the threshold value to detect a fault condition. Hence, during operation of the pump the difference between the first signal value and the second signal value is determined, and—if it is found that the difference becomes larger than the threshold value—an alarm is triggered indicating the presence of a fault condition.

In this regard, by comparing the difference between the first signal value and the second signal value with the threshold value it can be determined only if an upstream occlusion or a downstream occlusion is present. To differentiate between an upstream occlusion and a downstream occlusion, it could then be observed whether the first signal value indicative of a pressure downstream of the downstream valve mechanism rises during further operation of the pump. If yes, a downstream occlusion is present. If not, the fault condition is due to an upstream occlusion.

The threshold value is advantageously computed as the mean value of the first signal value and the second signal value, multiplied by a correction factor. In this regard, the threshold value may be set to equal the mean value of the first signal value and the second signal value multiplied by a correction factor such that the threshold value linearly changes with the mean value. It, however, is also conceivable that the threshold is assumed to saturate beyond a predefined maximum threshold value by setting the threshold value to equal the predefined saturated threshold value if the mean value of the first signal value and the second signal value exceeds the predefined saturated threshold value.

Beneficially, the threshold value is computed anew for each cycle of the periodic actuation of the peristaltic pump. Herein, the first signal value indicative of a pressure downstream the downstream valve mechanism and the second signal value indicative of a pressure upstream the upstream valve mechanism is advantageously computed from the measured pressure signal after completion of a cycle, and the measured pressure signal or a signal parameter derived from the measured pressure signal (for example the difference between the first signal value and the second signal value) for that cycle is compared with the computed threshold value of that cycle to detect a fault condition. The computation and comparison hence is carried out for a previous, completed cycle, wherein the computation of the threshold value may be performed for each cycle anew.

The first signal value indicative of a pressure value downstream the downstream valve mechanism is advantageously determined from a mean value of the pressure signal during an interval of the actuation of the drive mechanism during which the upstream valve mechanism is closed and the downstream valve mechanism is opened. In such interval the pressure inside the tube at the location of the pressure sensor (being located between the upstream valve mechanism and the downstream valve mechanism) approximately equals the pressure downstream the downstream valve mechanism such that the measured pressure signal is indicative of the pressure downstream the downstream valve mechanism. The second signal value indicative of a pressure value upstream the upstream valve mechanism, in turn, is determined from a mean value of the pressure signal in an interval of the actuation of the drive mechanism during which the upstream valve mechanism is opened and the downstream valve mechanism is closed. During this interval the pressure inside the tube at the location of the pressure sensor approximately equals the upstream pressure such that the measured pressure signal is indicative of the upstream pressure.

The object is furthermore achieved by a peristaltic pump comprising:

- a flexible tube for guiding a liquid to be pumped,
- a compression mechanism being actuatable for compressing the flexible tube,
- an upstream valve mechanism arranged in an upstream direction with respect to the compression mechanism and being actuatable to selectively open or close the flexible tube upstream of the compression mechanism,
- a downstream valve mechanism arranged in a downstream direction with respect to the compression mechanism and being actuatable to selectively open or close the flexible tube downstream of the compression mechanism,
- a drive mechanism for periodically actuating the compression mechanism, the upstream valve mechanism and the downstream valve mechanism,
- a pressure sensor for measuring a pressure signal indicative of a pressure in the flexible tube at a location between the upstream valve mechanism and the downstream valve mechanism, and
- a controller to control the operation of the peristaltic pump, the controller being operative to detect a fault condition during the operation of the peristaltic pump from the measured pressure signal.

The controller, for detecting a fault condition, is operative

- to compute from the measured pressure signal a first signal value indicative of a pressure value downstream the downstream valve mechanism and a second signal value indicative of a pressure value upstream the upstream valve mechanism,
- to compute a threshold value from the first signal value and the second signal value and
- to compare the measured pressure signal or at least one signal value derived from the measured pressure signal with the threshold value to detect the fault condition.

The advantages and advantageous embodiments described above with regard to the method analogously are applicable also to the peristaltic pump as noted above such that it shall be referred to the explanations above.

The compression mechanism of the flexible pump may be constituted by a single pump finger acting onto the flexible tube at a location between the upstream valve mechanism and the downstream valve mechanism. It however is also conceivable that the compression mechanism are constituted by a number of peristaltic fingers or other compressive means acting onto the flexible tube for compressing the flexible tube between the upstream valve mechanism and the downstream valve mechanism to pump liquid downstream through the flexible tube.

The drive mechanism may be constituted by any means suitable for periodically acting onto the compression mechanism, the upstream valve mechanism and the downstream valve mechanism to suitably induce a pumping action of liquid downstream through the flexible tube. In an advantageous embodiment the drive mechanism is constituted by a rotatable drive shaft carrying for example a number of cams acting onto the compression mechanism, the upstream valve mechanism and the downstream valve mechanism. For actuation of the compression mechanism, the upstream valve mechanism and the downstream valve mechanism, the drive shaft is rotated around its rotational axis such that the upstream valve mechanism, the downstream valve mechanism and the compression mechanism are periodically actuated. A cycle of the periodic actuation herein for example corresponds to the time equivalent to one revolution of the drive shaft around its rotational axis.

The peristaltic pump furthermore may comprise a position sensor for detecting the rotational position of the drive shaft during actuation of the compression mechanism, the upstream valve mechanism and the downstream valve mechanism. The position sensor herein issues a position signal during rotation of the drive shaft indicating intervals of the actuation. Because the pumping operation is periodic, such intervals repeatedly occur during repeated actuation of the compression mechanism, the upstream valve mechanism and the downstream valve mechanism. The position sensor may for example be constituted as an optical sensor acting together with an optical disc arranged on the drive shaft. The optical disc is rotated together with the drive shaft during operation of the peristaltic pump and comprises black (non-reflecting) and white (reflecting) faces causing a light signal to be selectively reflected or not during rotation of the drive shaft such that a periodic position signal is generated and output by the position sensor. Such position signal having the shape of a periodical wave form indicates intervals during rotation of the drive shaft and correlates the pressure signal issued by the pressure sensor with a position of the drive shaft during actuation of the compression mechanism, the upstream valve mechanism and the downstream valve mechanism.

The idea underlying the invention shall subsequently be described in more detail with reference to the embodiments shown in the figures. Herein, FIG. 1 shows a schematic view of a peristaltic pump;

Figure 1:
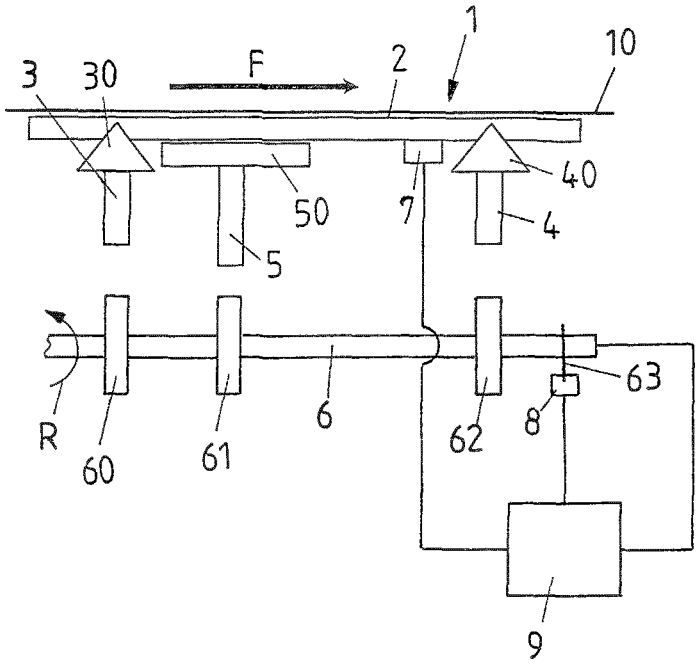

FIG. 1 shows in a schematic view a peristaltic pump 1 comprising a flexible tube 2, a compression mechanism 5, an upstream valve mechanism 3 and a downstream valve mechanism 4 interacting to transport a liquid contained in the tube 2 in a flow direction F.

The flexible tube 2 may for example be fabricated from a PVC material and hence is compressible in an easy and resilient manner in a direction perpendicular to the flow direction F. The upstream valve mechanism 3 and the downstream valve mechanism 4 each act with a finger head 30, 40 onto the flexible tube 2 for selectively closing or opening the flexible tube 2 such that a liquid may pass through the flexible tube 2 or not. The compression mechanism 5 is arranged, when viewed along flow direction F, between the upstream valve mechanism 3 and the downstream valve mechanism 4 and acts with a finger head 50 onto the tube 2 for compressing the flexible tube 2 in a section located between the upstream valve mechanism 3 and the downstream valve mechanism 4.

To actuate the compression mechanism 5, the upstream valve mechanism 3 and the downstream valve mechanism 4 in a sequential, periodic manner for transporting liquid through the tube 2 in the flow direction F a drive shaft 6 is provided which is rotatable in a direction of rotation R and carries three cams 60, 61, 62 acting onto the upstream valve mechanism 3, the compression mechanism 5 and the downstream valve mechanism 4, respectively.

Figure 2:
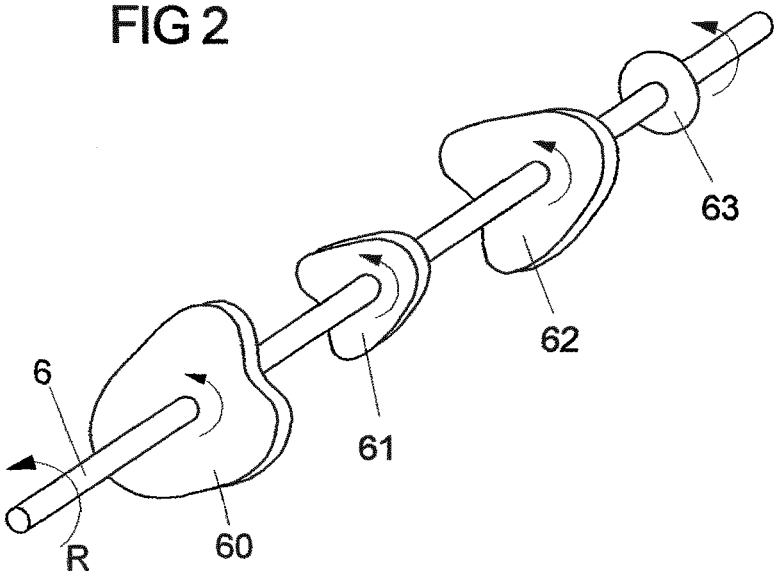
FIG. 2 shows a schematic, perspective view of a drive shaft carrying cams for actuating a compression mechanism, an upstream valve mechanism and a downstream valve mechanism of the peristaltic pump.

A schematic, perspective view of the drive shaft 6 with the cams 60, 61, 62 mounted thereon is shown in FIG. 2 and is known per se for example from U.S. Pat. No. 5,807,322.

When operating the peristaltic pump 1, the compression mechanism 5, the upstream valve mechanism 3 and the downstream valve mechanism 4 are actuated in a continuous manner by rotating the drive shaft 6, causing the liquid contained in the flexible tube 2 to be transported in the flow direction F. The flexible tube 2 in this regard rests against and is held in a support plate 10 (possibly arranged on a door of a housing of the peristaltic pump) serving as a support with respect to which the compression mechanism 5 for compressing the flexible tube 2 and the upstream valve mechanism 3 and the downstream valve mechanism 4 for selectively opening or closing the flexible tube 2 may be moved.

Between the upstream valve mechanism 3 and the downstream valve mechanism 4 a pressure sensor 7 is located being in contact with the flexible tube 2 for measuring a pressure signal at the flexible tube 2 indicative of the pressure within the flexible tube 2.

An optical disc 63 is mounted on the drive shaft 6 serving as a signal source for a position sensor 8. The optical disc 63 may for example comprise a number of black (non-reflective) and white (reflective) faces which selectively reflect a light signal such that the position sensor 8 outputs a position signal indicating the rotational position of the drive shaft 6.

In addition, a controller 9—for example in the shape of a control unit comprising a processor or microprocessor—is provided for controlling the operation of the drive shaft 6 and in addition for evaluating a pressure signal output by the pressure sensor 7 and a position signal output by the position sensor 8 to for example detect fault conditions during operation of the peristaltic pump 1.

A general setup of this kind is for example known from U.S. Pat. No. 5,807,322, which shall be included herein by reference.

Referring now to FIGS. 3 to 10A, 10B, subsequently the principle operation of the peristaltic pump 1 shall be described. Herein, different states of the peristaltic pump 1 (FIGS. 3, 4A-10A) as well as pressure signals P (in Volts) output by the pressure sensor 7 and position signals O associated with such different states of the peristaltic pump 1 (FIGS. 4B-10B) are shown, a change of state of the peristaltic pump 1 always being accompanied by a change in the pressure signal P as output by the pressure sensor 7.

In each case, the pressure signal P (in Volts) and the position signal O are shown in a diagrammatic view over time (in seconds). The pressure signal P being associated with the particular state of the peristaltic pump 1 is highlighted using a bold line.

Figure 3:
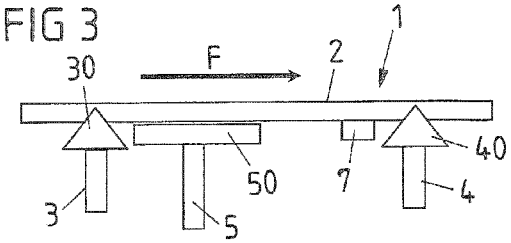
FIG. 3 shows the peristaltic pump in a first state.

In a first state of the peristaltic pump 1, shown in FIG. 3, the upstream valve mechanism 3 and the downstream valve mechanism 4 both are in a closed position hence closing the flexible tube 2 and preventing a flow through the flexible tube 2. In this first state, the compression mechanism 5 does not act onto the flexible tube 2 and, hence, does not compress the flexible tube 2.

Figure 4A:
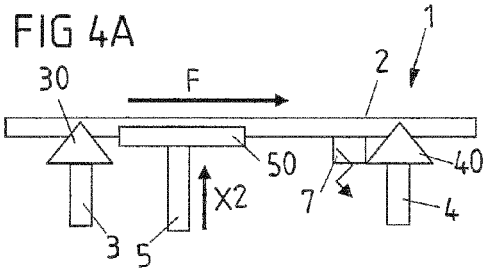
FIG. 4A shows the peristaltic pump in a second state.

In a second state, shown in FIG. 4A, the upstream valve mechanism 3 and the downstream valve mechanism 4 remain in their closed position, while the compression mechanism 2 is moved in a direction X1 to act onto the flexible tube 2 and to compress the flexible tube 2 in its section between the upstream valve mechanism 3 and the downstream valve mechanism 4. As shown FIG. 4B, due to the compression of the flexible tube 2, the pressure signal P rises up to a peak P1.

Figure 5A:
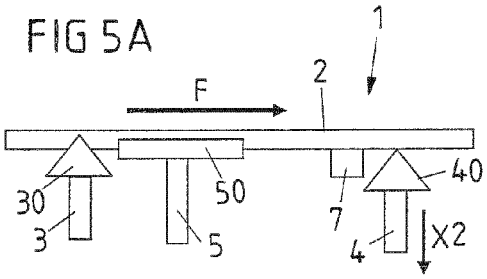
FIG. 5A shows the peristaltic pump in a third state.

In a third state of the peristaltic pump 1, shown in FIG. 5A, the upstream valve mechanism 3 and the compression mechanism 5 remain in their position, while the downstream valve mechanism 4 is opened by moving the finger head 40 in a direction X2 to let liquid contained in the flexible tube 2 between the upstream valve mechanism 3 and the downstream valve mechanism 4 flow in the flow direction F downstream. As visible in FIG. 5B, this leads to a drop of the pressure signal P.

Figure 6A:
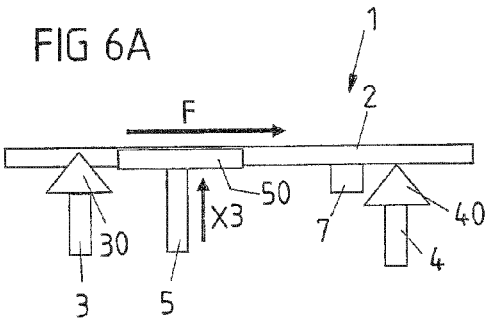
FIG. 6A shows the peristaltic pump in a fourth state.
Figure 4B:
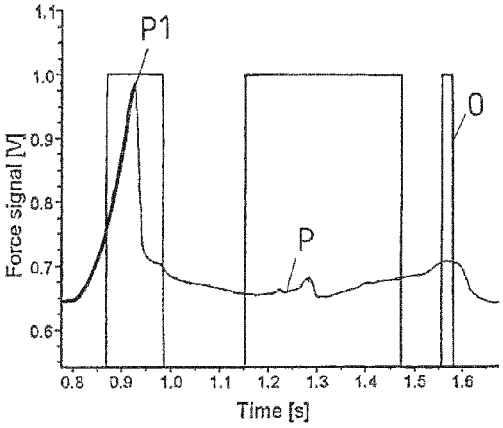
FIG. 4B shows a pressure signal associated with the second state.
Figure 5B:
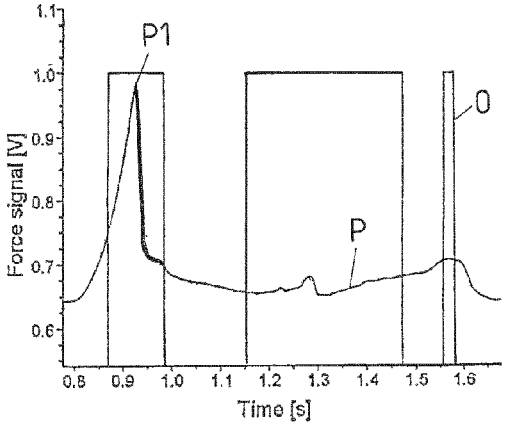
FIG. 5B shows a pressure signal associated with the third state.
Figure 6B:
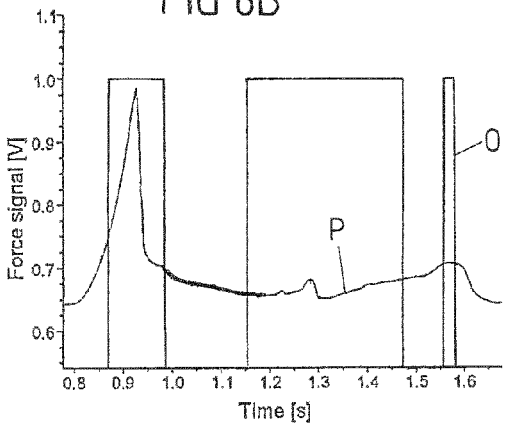
FIG. 6B shows a pressure signal associated with the fourth state.

In a forth state of the peristaltic pump 1, shown in FIG. 6A, the compression mechanism 5 is moved in a direction X3 to further compress the flexible tube 2 to support the transportation of liquid in the flow direction F. During this action of the compression mechanism 5, the pressure signal P drops only slightly (see FIG. 6B).

Figure 7A:
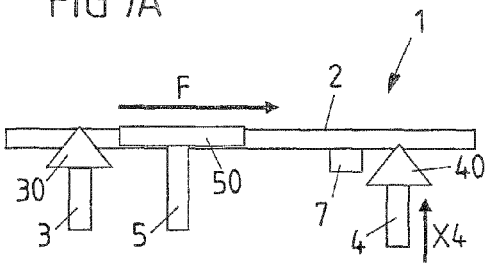
FIG. 7A shows the peristaltic pump in a fifth state.
Figure 7B:
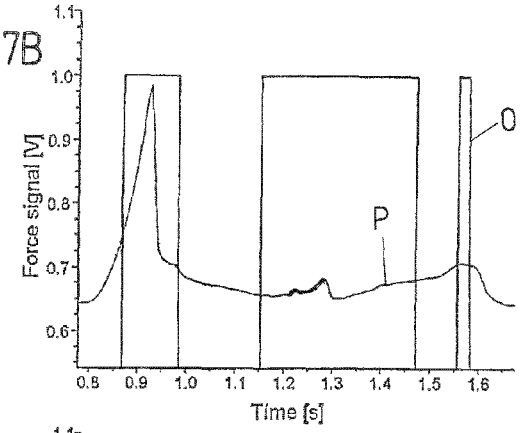
FIG. 7B shows a pressure signal associated with the fifth state.

In a fifth state, shown in FIG. 7A, the downstream valve mechanism 4 is closed and for this is moved in a direction X4, leading to a small rise in the pressure signal P (see FIG. 7B).

Figure 8A:
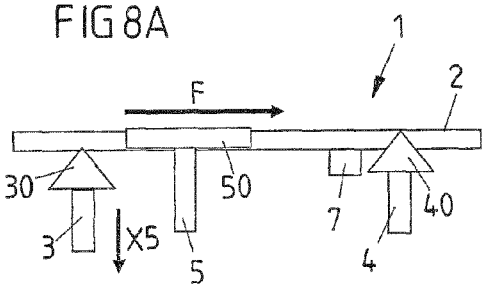
FIG. 8A shows the peristaltic pump in a sixth state.
Figure 8B:
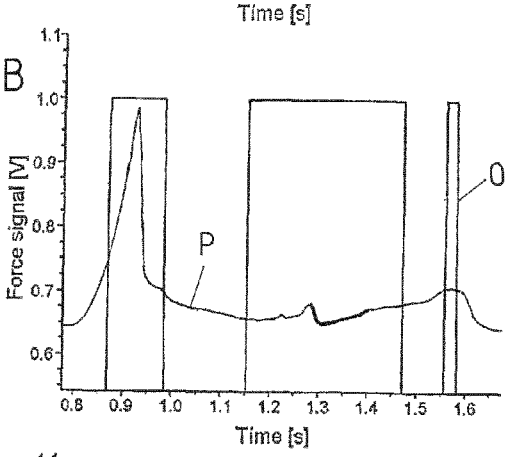
FIG. 8B shows a pressure signal associated with the sixth state.

In a sixth state, shown in FIG. 8A, the upstream valve mechanism 3 is opened and for this is moved with its finger head 30 in a direction X5 to let liquid pass into the section of the flexible tube 2 between the upstream valve mechanism 3 and the downstream valve mechanism 4, while the compression mechanism 5 and the downstream valve mechanism 4 remain in their previously assumed position. The opening of the upstream valve mechanism 3 causes a slight decrease in the pressure signal P, as shown in FIG. 8B.

Figure 9A:
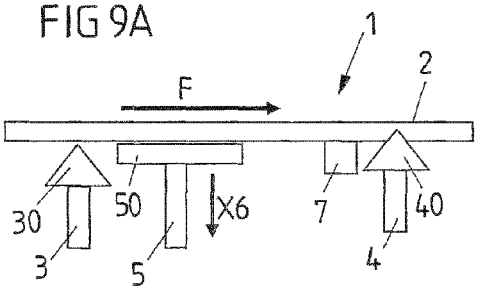
FIG. 9A shows the peristaltic pump in a seventh state.
Figure 9B:
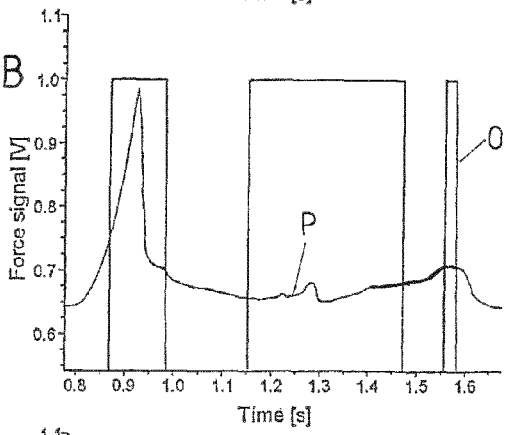
FIG. 9B shows a pressure signal associated with the seventh state.

In a seventh state, shown in FIG. 9A, the compression mechanism 5 is moved in a direction X6 to release the flexible tube 2 such that the flexible tube 2, due to its resiliency, is decompressed and assumes its original, non-compressed shape. Due to the decompression of the flexible tube 2, a slight rise in the pressure signal P occurs, as shown in FIG. 9B.

Figure 10A:
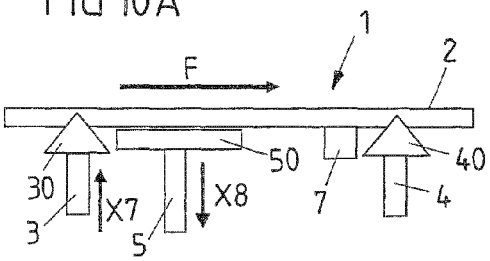
FIG. 10A shows the peristaltic pump in an eighth state.
Figure 10B:
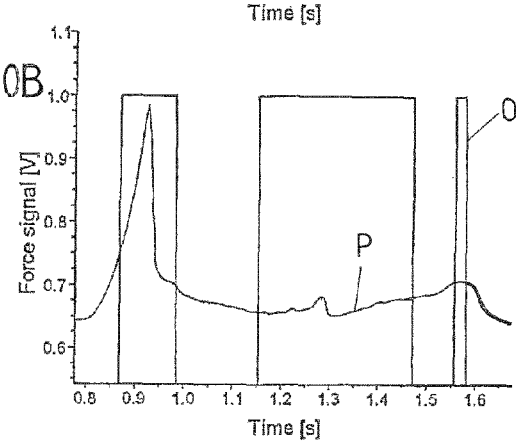
FIG. 10B shows a pressure signal associated with the eighth state.

In an eighth state, shown in FIG. 10A, finally the upstream valve mechanism 3 is closed again by moving the upstream valve mechanism 3 in a direction X7 to clamp off the flexible tube 2 and the compression mechanism 5 is further moved in a direction X8 to fully release the flexible tube 2, causing a slight decrease in the pressure signal P, as indicated in FIG. 10B.

Following the eighth state according to FIG. 10A the periodic cycle starts anew, such that, beginning with the first state according to FIG. 3, the compression mechanism 5, the upstream valve mechanism 3 and the downstream valve mechanism 4 are actuated by the drive shaft 6 and the cams 60, 61, 62 mounted thereon in a periodical manner, hence pumping the liquid in the flow direction F through the flexible tube 2.

In FIGS. 4B-10B, both the pressure signal P and the position signal O are indicated, the position signal O representing a wave form output by the position sensor 8 due to the detection of the rotational position of the drive shaft 6 by means of the optical disc 63.

Figure 11:
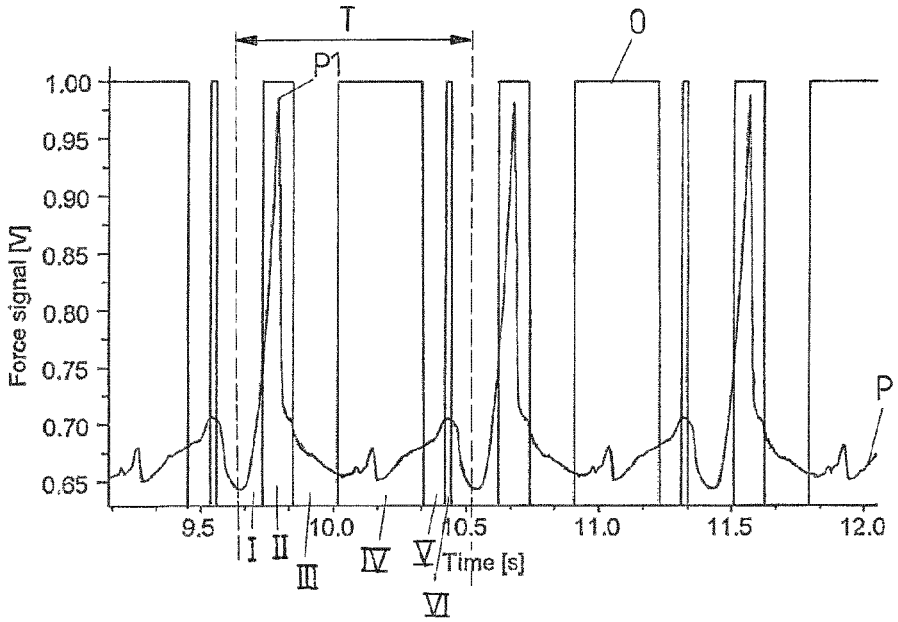
FIG. 11 shows a pressure signal measured by a pressure sensor and a position signal measured by a position sensor over multiple rotations of the drive shaft.

FIG. 11 shows in another diagrammatic view the pressure signal P and the position signal O over multiple cycles of operation of the peristaltic pump 1. Both the pressure signal P and the position signal O are periodic having a period T corresponding to one revolution of the drive shaft 6.

Figure 12:
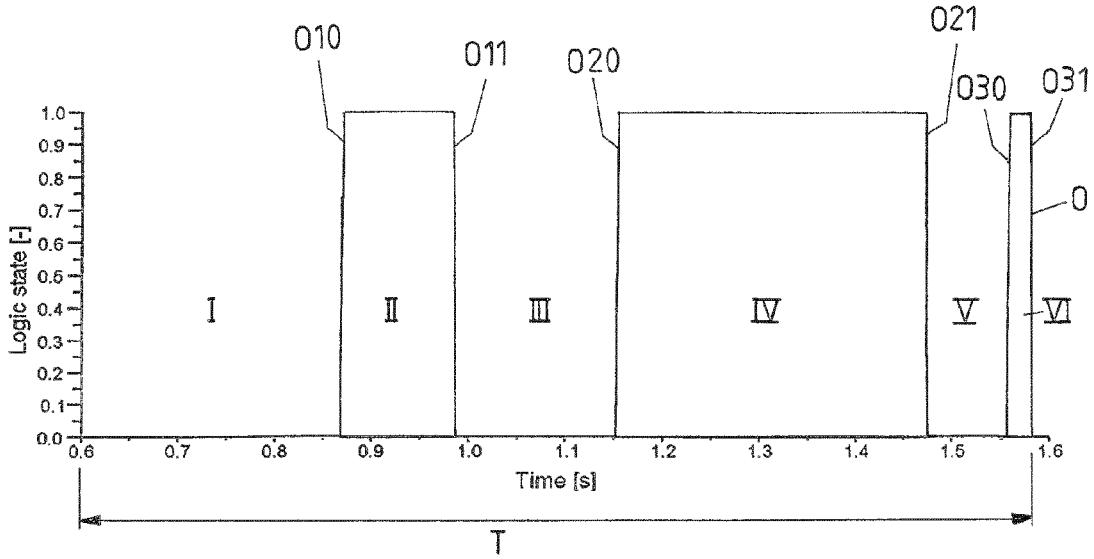
FIG. 12 shows the position signal in a separate diagrammatic view.

FIG. 12 shows in a separate diagrammatic view the position signal O over one period T. As visible from FIG. 12, the position signal O is represented by a wave form which, throughout one period T corresponding to one revolution of the drive shaft 6, exhibits six intervals I, II, III, IV, V, VI defined and distinguished by rising and falling edges O10, O20, O21, O30, O31 of the position signal O. By means of the position signal O, hence, six intervals I, II, III, IV, V, VI corresponding to fractions of the period T during one revolution of the drive shaft 6 are defined, which can be used to analyse the pressure signal P for example to detect a fault condition such as an upstream occlusion or a downstream occlusion of the flexible tube 2 or an empty-bag condition occurring when a bag supplying liquid to the flexible tube 2 is empty.

The interval II, for example, corresponds to the second and third state as described above according to FIGS. 4A, 4B and 5A, 5B during which the flexible tube 2 is compressed and then opened in the downstream direction leading to the formation of a peak P1.

In the interval III, corresponding to the forth state described above according to FIGS. 6A, 6B, the downstream valve mechanism 4 is opened such that the pressure signal P approximately indicates the pressure in the flexible tube 2 downstream of the downstream valve mechanism 4.

And in the interval V, corresponding to the seventh state described above according to FIGS. 9A, 9B, the downstream valve mechanism 4 is closed and the upstream valve mechanism 3 is opened such that the pressure signal P approximately indicates an upstream pressure upstream of the upstream valve mechanism 3.

By evaluating the pressure signal P in predefined intervals, fault conditions during operation of the peristaltic pump 1 can be determined.

Figure 13:
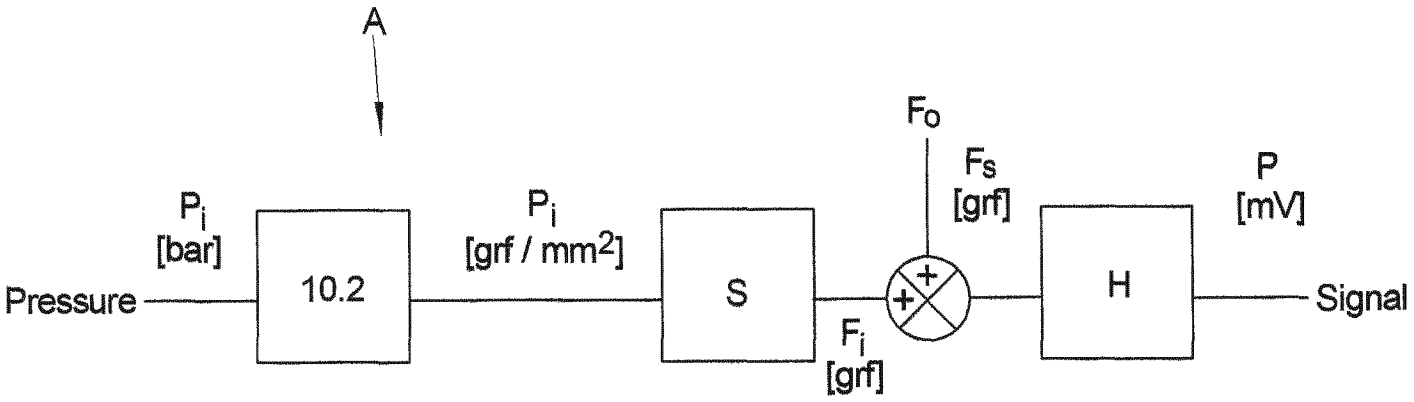
FIG. 13 shows a schematic view of an acquisition chain via which an actual pressure inside a tube is linked to a measured pressure signal output by a pressure sensor.

FIG. 13 shows a schematic view of an acquisition chain A via which the actual pressure $P_i$ inside the tube 2 is linked to the measured pressure signal P output by the pressure sensor 7. The actual pressure $P_i$ inside the tube 2 herein is given in bar, whereas the measured pressure signal P output by the pressure sensor 7 represents a voltage signal in Volt or Millivolt.

For a given pressure $P_i$ present inside the tube 2 the resulting pressure signal P (voltage signal) output by the pressure sensor 7 is $$P=HF_0+10.2HSP_i \tag{1}$$

Herein, H represents the transfer function of the system of the pressure sensor including the sensor itself and a possible amplification. $F_0$ represents a force acting onto the tube 2 due to the arrangement of the tube 2 on for example a support plate 10 of the peristaltic pump 1 and/or the squeezing of the tube 2 by a door of the peristaltic pump 1. The force $F_0$ hence indicates the strain on the tube 2 due to compressing the tube 2 when arranging it on the peristaltic pump 1. The term S indicates the surface area via which the pressure sensor 7 is in contact with the tube 2. And the term 10.2 indicates a conversion factor via which the pressure $P_i$ inside the tube 2 is converted from bar into gram-force per millimeter squared (grf/mm$^2$).

Within the acquisition chain A the pressure $P_i$ inside the tube 2 is converted into a force $F_i$ due to the pressure inside the tube 2, which is added to the force $F_0$ due to the strain on the tube 2 caused by its arrangement on the peristaltic pump 1. The resulting force $F_s$ is modified by the transfer function H, resulting in the output pressure signal P (in mV).

If $F_0$, H and S are known, the actual value of the pressure $P_i$ inside the tube 2 can be derived from the measured pressure signal P. Because such terms in general are not known, conventionally a calibration is carried out by measuring the pressure signal P for two known pressure values $P_i$ inside the tube 2. For this, the pressure $P_i$ inside the tube 2 may be controlled by a manometer and measurements for example for pressure values of 0 bar and 1 bar may be taken, obtaining $$P_{0bar}=HF_0 \tag{2}$$

$$P_{1bar}=HF_0+10.2HS. \tag{3}$$

Using such calibration measurements, the actual pressure $P_i$ inside the tube 2 can be determined from any measured pressure signal P to be $$P_i = \frac{P - P_{0bar}}{P_{1bar} - P_{0bar}}. \tag{4}$$

Using such a calibration, an alarm threshold for determining whether a fault condition such as a downstream occlusion or an upstream occlusion is present may be set directly in bar, hence in terms of the pressure $P_i$ inside the tube 2.

However, because a calibration usually can be carried out only prior to the normal operation of the peristaltic pump 1 and because peristaltic pumps 1 and their components are subject to dispersion due to for example mechanical wear and tear, a varying temperature or a modification in the system setup for example due to a replacement of a door of a system, such calibration may become inaccurate yielding unreliable results when comparing an actual pressure $P_i$ determined from a measured pressure P to a threshold value set within the configuration of the system.

In order to avoid the necessity for a calibration, a new approach is proposed based on the idea to compute a threshold value directly from the measured pressure signal P. In this regard, a threshold value is computed from a first signal value indicative of a pressure value downstream the downstream valve mechanism 4 and a second signal value indicative of a pressure value upstream the upstream valve mechanism 3. The first signal value and the second signal value are directly taken from the measured pressure signal P without converting it into the actual pressure $P_i$ inside the tube 2, such that a knowledge of the terms of H, $F_0$ and S of the acquisition chain A is not necessary.

According to an embodiment of the invention, the first signal value indicative of a pressure downstream of the downstream valve mechanism 4 is $$P_{down}=HF_0+10.2HSP_{i,down}. \tag{5}$$

The second signal value indicative of a pressure upstream the upstream valve mechanism 3 is $$P_{up}=HF_0+10.2HSP_{i,up}. \tag{6}$$

Herein, the first signal value $P_{down}$ indicative of the actual pressure value $P_{i,down}$ downstream the downstream valve mechanism 4 is for example determined from the mean value of the pressure signal P during the interval III as indicated above in FIG. 11, and the second signal value $P_{up}$ indicative of the actual pressure value $P_{i,up}$ upstream the upstream valve mechanism 3 is determined from the mean value of the pressure signal P in the interval V.

The threshold value is then determined as the mean value of the first signal value and the second signal value, multiplied by a correction factor k smaller than 1, yielding:

$$\text{threshold}=k(P_{down}+P_{up})/2=k(HF_0+10.2HS(P_{i,down}+P_{i,up})/2). \tag{7}$$

The threshold value is computed anew for every cycle T during operation of the peristaltic pump 1. Herein, the threshold value for a given cycle T (see for example FIG. 11) is computed after completion of the cycle T.

During operation of the peristaltic pump 1, the difference between the first signal value (downstream pressure signal) and the second signal value (upstream pressure signal) is derived from the measured pressure signal P, and this difference is compared to the threshold for each cycle T. If the difference exceeds the threshold, an occlusion situation is detected.

By comparing the difference of the first signal and the second signal to the threshold, it can only be detected whether an occlusion situation is present or not, but it cannot—without further ado—be differentiated between a downstream occlusion and an upstream occlusion. To differentiate between a downstream occlusion and an upstream occlusion following the detection of an occlusion situation, it may be observed for example whether, during following cycles T, the first signal value (downstream pressure value) rises. If yes, a downstream occlusion is present. If not, an upstream occlusion is present.

During normal pumping operation the difference between the first signal value and the second signal value is very small and equals approximately 0. Hence, during normal pumping operation (without the presence of an occlusion), the threshold becomes approximately $$\text{threshold}=kHF_0. \tag{8}$$

Herein, for a given pump, H and $F_0$ are not known, but in general for all pumps the minimum and maximum values of H and $F_0$ are known. The dispersion of H in this regard is of no importance because the threshold and the measured pressure signal P are proportional to H, such that the ratio of the measured pressure signal P and the threshold is independent of H. The term $F_0$ indicating the force by which the tube 2 is squeezed for example by a door of a peristaltic pump 1 changes due to mechanical dispersion such as for different doors used in a peristaltic pump 1. However, the effects of such dispersion are reduced as compared to the dispersion effect on the accuracy of the calibration.

In case of an occlusion, the threshold changes as compared to the normal pumping operation. In case of a downstream occlusion the downstream pressure $P_{i,down}$ increases, such that the threshold becomes larger. In case of an upstream occlusion, the upstream pressure $P_{i,up}$ becomes negative (i.e., it falls below the atmospheric pressure), and hence the threshold decreases, which is of interest because upstream occlusions are in general more difficult to detect such that the threshold for an upstream occlusion should be set to a lower value as compared to the threshold for a downstream occlusion.

The difference between the first signal value and the second signal value can be expressed as $$\text{difference}=P_{down}-P_{up}=10.2HS(P_{i,down}-P_{i,up}). \tag{9}$$

Such difference is independent on $F_0$. For setting the threshold, in particular for determining a reasonable value for the correction factor k, one can start with the assumption that in case of an occlusion the difference shall exceed the threshold:

$$\text{difference} > \text{threshold} \tag{10}$$

$$10.2HS(P_{i,down}-P_{i,up}) > k(\mathrm{HF}_0+10.2HS(P_{i,down}+P_{i,up})/2)$$

$$1 > k\left(\frac{F_0}{10.2S(P_{i,down}-P_{i,up})}+\frac{1}{2}\frac{P_{i,down}+P_{i,up}}{P_{i,down}-P_{i,up}}\right)$$

Hence, the ratio of the threshold and the difference comprises two terms of which the first is a function of the equivalent pressure applied to the tube 2 when squeezed against the pressure sensor 7, $F_0/(10.2S)$. For setting the correction factor k its minimum and maximum values must be assessed under all possible dispersion conditions of the peristaltic pump 1. The second term varies between −k/2 (in case of an upstream occlusion) and k/2 (in case of a downstream occlusion). Knowing the variations of $F_0/(10.2S)$ for a peristaltic pump 1 and taking into account the second term $k/2(P_{i,down}+P_{i,up})/(P_{i,down}-P_{i,up})$ one can choose a proper value of the correction factor k for determining a reliable threshold value for detecting a downstream occlusion and an upstream occlusion.

For determining whether an upstream occlusion or a downstream occlusion is present, it is also conceivable to use two different threshold values. In that case, to set the two threshold values, i.e. an upstream occlusion threshold and a downstream occlusion threshold, actually different values for the correction factor k are employed.

For choosing a proper value for the correction factor k, one can for example assume for the term $F_0/(10.2S)$ a maximum value of 2 bars. If a downstream occlusion alarm shall be triggered once the downstream pressure $P_{i,down}$ rises above 1.5 bar, one obtains from relations (10) as stated above $$k<1/1.83, \tag{11}$$

assuming that $P_{i,up}=0$ (relative pressure measured relative to atmospheric pressure) in case of a downstream occlusion. The correction factor hence may be chosen to equal ½ to set the downstream occlusion threshold.

If an upstream occlusion alarm shall be triggered once the upstream pressure $P_{i,up}$ falls below −0.25 bar (relative pressure), one obtains from relations (10) as stated above $$k<1/7.5. \tag{12}$$

The correction factor k thus may be chosen to equal ⅛ to set the upstream occlusion threshold. The upstream occlusion threshold hence is smaller than the downstream occlusion threshold.

Having set the upstream occlusion threshold and the downstream occlusion threshold, in operation the difference between the first signal value (downstream pressure signal) and the second signal value (upstream pressure signal) is derived from the measured pressure signal P and is compared to the upstream occlusion threshold. If the upstream occlusion threshold is reached during a cycle T, it is observed during the following cycles T if the first signal value (downstream pressure signal) rises and if the difference of the signal values reaches also the downstream occlusion threshold. If yes, a downstream occlusion is present and a corresponding alarm is triggered. If instead the second signal value (upstream pressure signal) during the following cycles T decreases (while the second signal value stays approximately constant), it is concluded that an upstream occlusion is present.

The idea underlying the invention is not limited to the embodiments described above.

In particular, a compression mechanism different than the one used in the described embodiment may be employed, for example comprising multiple peristaltic fingers acting onto the flexible tube.

The drive mechanism not necessarily must be constituted by a rotatable drive shaft but may employ any suitable means for actuating the compression mechanism, the upstream valve mechanism and the downstream valve mechanism.

A peristaltic pump of the kind described herein may in particular be used for delivery of liquid nutriments for the enteral feeding of patients in a hospital environment. However, the application of a peristaltic pump of the noted kind is not limited to this specific purpose, but the peristaltic pump may be used also for a delivery of any other liquid such as blood or other medical solutions.

LIST OF REFERENCE NUMERALS

1 Peristaltic pump
10 Support plate (door)
2 Tube
3, 4 Valve mechanism (clamp finger)
30, 40 Finger head
5 Compression mechanism (pump finger)
50 Finger head
6 Drive shaft
60-62 Cam
63 Optical disc
7 Pressure sensor
8 Position sensor
9 Controller
A Acquisition chain
F Flow direction
$F_i$ Force
$F_s$ Force
$F_0$ Force
H Transfer function
O Position signal
O10, O11, O20, O21, O30, O31 Edge
P Measured pressure signal
P1 Peak
$P_i$ Actual pressure
R Direction of rotation
S Surface area of sensor
T Period
X1-X8 Direction of motion
I-VI Interval

The invention claimed is:

1. A method for operating a peristaltic pump, the peristaltic pump comprising: —a flexible tube for guiding a liquid to be pumped, —a compression mechanism being actuatable for compressing the flexible tube, —an upstream valve mechanism arranged in an upstream direction with respect to the compression mechanism and being actuatable to selectively open or close the flexible tube upstream of the compression mechanism and —a downstream valve mechanism arranged in a downstream direction with respect to the compression mechanism and being actuatable to selectively open or close the flexible tube downstream of the compression mechanism, wherein a drive mechanism periodically actuates the compression mechanism, the upstream valve mechanism, and the downstream valve mechanism; and a pressure sensor measures a pressure and outputs a pressure signal indicative of a pressure in the flexible tube at a location between the upstream valve mechanism and the downstream valve mechanism, wherein, for detecting a fault condition, —a first signal value indicative of a pressure value downstream of the downstream valve mechanism and a second signal value indicative of a pressure value upstream of the upstream valve mechanism are computed from the measured pressure signal, —a threshold value is computed from the first signal value and the second signal value, and —the measured pressure signal or at least one signal parameter derived from the measured pressure signal is compared with the threshold value to detect the fault condition; and wherein the threshold value is computed as the mean value of the first signal value and the second signal value, multiplied by a correction factor; wherein in the case of detecting the fault condition, an alarm is triggered to indicate the fault condition.

2. The method according to claim 1, wherein the fault condition is a downstream occlusion or an upstream occlusion.

3. The method according to claim 2, wherein in the case of the downstream occlusion the first signal value is increased.

4. The method according to claim 2, wherein in the case of the upstream occlusion the second signal value is decreased.

5. The method according to claim 1, wherein as a signal parameter, a difference between the first signal value and the second signal value is determined and compared with the threshold value to detect the fault condition.

6. The method according to claim 1, wherein the threshold value is set to equal a predefined saturated threshold value if the mean value of the first signal value and the second signal value exceeds the predefined saturated threshold value.

7. The method according to claim 1, wherein the threshold value for a cycle of the periodic actuation by the drive mechanism is computed after said cycle is finished, and the measured pressure signal or at least one signal parameter derived from the measured pressure signal during said cycle is compared with the computed threshold value to detect the fault condition during said cycle.

8. The method according to claim 1, wherein —the first signal value indicative of a pressure value downstream of the downstream valve mechanism is determined from a mean value of the pressure signal during an interval of the actuation of the drive mechanism during which the upstream valve mechanism is closed and the downstream valve mechanism is opened and —the second signal value indicative of a pressure value upstream of the upstream valve mechanism is determined from a mean value of the pressure signal during an interval of the actuation of the drive mechanism during which the upstream valve mechanism is opened and the downstream valve mechanism is closed.

9. A peristaltic pump, comprising: —a flexible tube for guiding a liquid to be pumped, —a compression mechanism being actuatable for compressing the flexible tube, —an upstream valve mechanism arranged in an upstream direction with respect to the compression mechanism and being actuatable to selectively open or close the flexible tube upstream of the compression mechanism, —a downstream valve mechanism arranged in a downstream direction with respect to the compression mechanism and being actuatable to selectively open or close the flexible tube downstream of the compression mechanism, —a drive mechanism for periodically actuating the compression mechanism, the upstream valve mechanism, and the downstream valve mechanism, —a pressure sensor for measuring a pressure and outputting a pressure signal indicative of a pressure in the flexible tube at a location between the upstream valve mechanism and the downstream valve mechanism, and —a controller to control the operation of the peristaltic pump, the controller being operative to detect a fault condition during the operation of the peristaltic pump from the measured pressure signal, wherein the controller, for detecting the fault condition, is operative —to compute from the measured pressure signal a first signal value indicative of a pressure value downstream of the downstream valve mechanism and a second signal value indicative of a pressure value upstream of the upstream valve mechanism, —to compute a threshold value from the first signal value and the second signal value, the threshold value being computed as the mean value of the first signal value and the second signal value, multiplied by a correction factor and —to compare the measured pressure signal or at least one signal value derived from the measured pressure signal with the threshold value to detect the fault condition; wherein in the case of detecting the fault condition, an alarm is triggered to indicate the fault condition.

10. The peristaltic pump according to claim 9, wherein the drive mechanism is constituted by a rotatable drive shaft.

11. The peristaltic pump according to claim 10, wherein the peristaltic pump comprises a position sensor for detecting a rotational position of the rotatable drive shaft during actuation of the compression mechanism, the upstream valve mechanism, and the downstream valve mechanism.

* * * * *